US006080278A

United States Patent [19]

Heaven et al.

[11] Patent Number: 6,080,278

[45] **Date of Patent: *Jun. 27, 2000**

[54] FAST CD AND MD CONTROL IN A SHEETMAKING MACHINE

[75] Inventors: E. Michael Heaven, N. Vancouver; Claud Hagart-Alexander, Vancouver, both of Canada; Lee Chase, Los Gatos; John D. Goss, San Jose, both of Calif.; David Watson, Etobicoke, Canada

[73] Assignee: Honeywell-Measurex Corporation, Cupertino, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/013,867

[22] Filed: Jan. 27, 1998

[51] Int. Cl.[7] ..... D21F 11/00

[52] U.S. Cl. ..... 162/198; 162/252; 162/253; 162/254; 162/255; 162/256; 162/257; 162/258; 162/259; 162/262; 162/DIG. 10; 162/DIG. 11

[58] Field of Search ..... 162/198, 252, 162/253, 254, 255, 256, 257, 258, 259, 262, DIG. 10, DIG. 11

[56] References Cited

U.S. PATENT DOCUMENTS

| | | | |
|---|---|---|---|
| 2,922,475 | 1/1960 | Alexander | 162/252 |
| 3,206,642 | 9/1965 | Canter et al. . | |
| 3,593,128 | 7/1971 | Perry . | |
| 3,630,836 | 12/1971 | Bietry et al. . | |
| 3,636,327 | 1/1972 | Troutman . | |
| 3,646,434 | 2/1972 | Norwich . | |
| 3,654,075 | 4/1972 | Keyes et al. . | |
| 3,666,621 | 5/1972 | Adams | 162/252 |
| 3,713,966 | 1/1973 | Lippke . | |
| 3,723,712 | 3/1973 | Komline, Sr. et al. . | |
| 3,723,865 | 3/1973 | Batey et al. . | |
| 3,795,984 | 3/1974 | Meyer . | |
| 3,811,087 | 5/1974 | Schmelzer . | |
| 3,864,626 | 2/1975 | MacLean et al. . | |
| 3,909,380 | 9/1975 | Day et al. . | |
| 3,986,110 | 10/1976 | Overall et al. . | |
| 4,135,151 | 1/1979 | Rogers et al. . | |
| 4,259,632 | 3/1981 | Ahtiainen . | |

(List continued on next page.)

FOREIGN PATENT DOCUMENTS 0276106 7/1988 European Pat. Off. .

OTHER PUBLICATIONS

Smook, G.A., Handbook for Pulp & Paper Technologist, 2d. ed., (Angus Wilde Publications), 1992, pp. 228–229.

*Primary Examiner*—John Hoffmann
*Attorney, Agent, or Firm*—Burns, Doane, Swecker & Mathis L.L.P.

[57] ABSTRACT

A system and method of providing fast machine direction (MD) and cross direction (CD) basis weight adjustments using a simultaneous multi-point water weight sensor which provides independent MD and CD measurements is described. The water weight sensor is placed under the wire of the sheetmaking machine and provides fast wet end water weight measurements which are converted into predicted dry end basis weight information and used to control operating variables of machine elements in the sheetmaking machine to compensate for high frequency process variations. MD wet end measurements are used to control operating variables of machine elements that influence the MD dry end basis weight and CD wet end measurements are used to control operating variables of machine elements that influence CD dry end basis weight. The fast control information provided by the non-scanned water weight sensor can be used in a fast control loop which provides feedback information to wetstock source, headbox and forming elements and which can be used with a slower response control loop including a dry end sensor which provides a slower basis weight measurement and which controls system variables to compensate for larger basis weight fluctuations.

16 Claims, 7 Drawing Sheets

U.S. PATENT DOCUMENTS 4,314,878 2/1982 Lee .
4,329,201 5/1982 Bolton .
4,369,080 1/1983 Johnson .
4,374,703 2/1983 Lebeau et al. ..... 162/253
4,398,996 8/1983 Bolton et al. .
4,468,611 8/1984 Tward .
4,474,643 10/1984 Lindblad .
4,514,812 4/1985 Miller et al. .
4,535,285 8/1985 Evans et al. .
4,580,233 4/1986 Parker et al. .
4,588,943 5/1986 Hirth .
4,613,406 9/1986 Gess .
4,648,715 3/1987 Ford, Jr. et al. .
4,680,089 7/1987 Aral et al. .
4,692,616 9/1987 Hegland et al. .
4,707,779 11/1987 Hu .
4,748,400 5/1988 Typpo .
4,786,529 11/1988 Boissevain .
4,791,353 12/1988 Typpo .
4,817,021 3/1989 Sowerby et al. .
4,827,121 5/1989 Vidrine, Jr. et al. .
4,840,706 6/1989 Campbell .
4,845,421 7/1989 Howarth et al. .
4,903,528 2/1990 Balakrishnan et al. .
4,909,070 3/1990 Smith .
4,921,574 5/1990 Hu .
4,924,172 5/1990 Homgren .
4,947,684 8/1990 Balakrishnan .
4,957,770 9/1990 Howarth .
4,980,846 12/1990 Chapman .
4,986,410 1/1991 Shields .
4,990,261 2/1991 Ho .
4,994,145 2/1991 Seymour .
5,013,403 5/1991 Chase .
5,020,469 6/1991 Boissevain et al. .
5,021,740 6/1991 Sarr et al. .
5,022,966 6/1991 Hu .
5,045,798 9/1991 Hendrick .
5,052,223 10/1991 Regnault et al. .
5,067,345 11/1991 Mougne .
5,071,514 12/1991 Francis ..... 162/259
5,093,795 3/1992 Lewis .
5,122,754 6/1992 Gotaas .
5,124,552 6/1992 Anderson .
5,132,631 7/1992 Klopfenstein et al. .
5,134,380 7/1992 Jonas .
5,170,128 12/1992 Masurat et al. .
5,170,670 12/1992 Fasching et al. .
5,177,445 1/1993 Cross .
5,198,777 3/1993 Masuda et al. .
5,206,599 4/1993 Mayer .
5,208,544 5/1993 McBrearty et al. .
5,225,785 7/1993 Mayer et al. .
5,241,280 8/1993 Aidun et al. .
5,244,550 9/1993 Inoue .
5,247,261 9/1993 Gershenfeld .
5,262,955 11/1993 Lewis .
5,270,664 12/1993 McMurtry et al. .
5,280,250 1/1994 Jayaweera et al. .
5,340,442 8/1994 Gess et al. .
5,400,247 3/1995 He .
5,421,961 6/1995 Miller ..... 162/252
5,450,015 9/1995 Mastico et al. .
5,492,601 2/1996 Ostermayer et al. .
5,493,910 2/1996 Hall et al. .
5,539,634 7/1996 He .
5,561,599 10/1996 Lu .
5,563,809 10/1996 Williams et al. .
5,622,602 4/1997 Yakabe et al. ..... 162/252
5,636,126 6/1997 Heaven et al. .
5,658,432 8/1997 Heaven et al. .
5,853,543 12/1998 Hu et al. ..... 162/198

FAST CD AND MD CONTROL IN A SHEETMAKING MACHINE

BACKGROUND OF THE INVENTION

1. Field of the Invention

The present invention relates to monitoring and controlling quality in a continuous sheetmaking machine, and more particularly, to fast machine and cross direction control of headbox and forming elements of a sheetmaking machine using wet end measurements.

2. State of the Art

In the manufacture of paper using a continuous sheetmaking machine, a web of paper is formed from an aqueous suspension of fibers (stock). Stock is dispersed from a dispensing unit referred to as a headbox onto a traveling mesh wire or fabric and water drains by gravity and vacuum suction through the fabric. The web is then transferred to the pressing section where more water is removed by dry felt and pressure. The web next enters the dry section where steam heated dryers and hot air completes the drying process. The sheetmaking machine is essentially a de-watering, i.e., water removal system. In the sheetmaking art, the term machine direction (MD) refers to the direction that the sheet material travels during the manufacturing process, while the term cross direction (CD) refers to the direction across the width of the sheet which is perpendicular to the machine direction. Furthermore, in general, the elements of the system including the headbox, the web, and those sections just before the dryer are referred to as the "wet end". The "dry end" generally includes the sections downstream from the dryer. Papermaking elements and machines are well known in the art and are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking machines are further described, for example, in U.S. Pat. Nos. 5,539,634, 5,022,966 4,982,334, 4,786,817, and 4,767,935.

In the art of making paper the sheet properties must be continually monitored and the sheetmaking machine controlled and adjusted to assure sheet quality and to minimize the amount of finished product that is rejected. This control is performed by measuring sheet variables at various stages in the manufacturing process which most often include basis weight, moisture content, and caliper (i.e., thickness) of the sheet, and using this information to adjust various elements within the sheetmaking machine to compensate for variations in the sheetmaking process.

Typically, a scanning sensor is used to perform basis weight measurements of the finished sheet at the dry end of the sheetmaking machine. Scanning sensors are known in the art and are described, for example, in U.S. Pat. Nos. 5,094,535, 4,879,471, 5,315,124, and 5,432,353. The scanning sensor continuously traverses the finished sheet in the cross-direction of the sheetmaking machine. Since the web is moving while the sensor is being scanned, the scanning sensor traverses a diagonal path across the sheet and, as a result, the measured basis weight information provided from the scanning sensor relates to variations in both the machine-direction and cross-direction of the web. The interrelated CD and MD basis weight scanner measurements are further processed and averaged with previous scans to obtain an estimation of independent CD and MD basis weight measurements. Sheetmaking machines are designed with the capability of being independently adjusted to compensate for both CD and MD process variations. The estimated CD and MD basis weight measurements obtained from the scanner are used to control elements in the sheetmaking machine to adjust basis weight in both of these directions.

One of the main disadvantages of scanning sensors is the amount of time that passes from the time that process variations occur in the sheetmaking process to the time the scanning sensor can detect the variations and initiate compensating system adjustments. A typical scan time, (i.e., the amount of time it takes for the scanner to traverse the web) is approximately 16 inches/sec generally resulting in a full sheet scan time of 10–30 seconds. An estimation is obtained by taking 5–8 scans to provide an accurate estimation of the cross and machine direction basis weights. As a result, it can take from 3–15 minutes to obtain CD and MD basis weight measurements using a scanning sensor at the dry end of the sheetmaking machine.

Hence, a sheetmaking machine using a scanning sensor to detect basis weight provides a relatively slow response time to variations in basis weight due to the delay time involved in obtaining basis weight measurements from the scanning sensor. As a result, a sheetmaking machine using a scanning-type sensor is ineffective for detecting rapid variations (i.e., high frequency) in basis weight and particularly variations that occur in the time period less than the amount of time it takes to obtain the basis weight information. In addition, the CD and MD basis weight measurements obtained from the scanning sensor are only an estimation of the actual CD and MD basis weight since the scanning device measurement can only provide interdependent CD/MD basis weight measurements.

What is needed is an manner in which to detect high frequency process variations in an independent manner in both the machine and cross directions and use these detected variations to independently adjust MD and CD controllable elements in the system.

SUMMARY OF THE INVENTION

The present invention is a system and method for detecting high frequency variations in basis weight at the wet end of a sheetmaking machine and providing on-line control to elements in the system to compensate for the detected variations. The sheetmaking machine is designed with non-scanning sensors which provide simultaneous multiple point wet end, water weight measurements across either/or both of the machine direction (MD) and cross direction (CD) of the sheetmaking machine. These water weight measurements are converted into predicted dry end basis weight measurements. The predicted basis weight measurements are then used to make quick system adjustments to elements in the sheetmaking machine to compensate for process variations. The non-scanning sensors obtain independent MD and the CD water weight measurements and hence can independently monitor predicted basis weight of the dry sheet in each of the cross and machine directions. In addition, the non-scanning sensors are situated in the wet end of the sheetmaking machine thereby providing quick basis weight readings.

The predicted dry end basis weight information is provided to at least one system controller which, in response, provides on-line control signals for adjusting operating variables of sheetmaking machine elements. In a particular embodiment, the wet end sensors are under wire water weight ($UW^3$) sensors which are responsive to changes in conductivity of the aqueous stock material at the wet end of the system. In one embodiment, operating variables that can be adjusted by the on-line control signals include headbox pressure, headbox flow, headbox total diluation, jet-to-wire ratio, forming board machine direction position relative to the wetstock impingement region, and forming board angular position relative to the wire. On-line control signals can also be used to control wetstock source elements which feed wetstock to the headbox.

In another embodiment, a sheetmaking machine includes first and second control loops for controlling operating variables of machine elements in the sheetmaking machine to compensate for process variations. The first control loop includes a non-scanning wet end measurement sensor for obtaining independent wet end basis weight measurements in both the MD and CD, a dry end basis weight predictor for converting the independent wet end basis weight measurements in both the MD and CD into predicted independent dry end basis weight measurements in both the MD and CD, and a first controller responsive to the predicted independent dry end basis weight measurements. The first control loop has a relatively quick response time and hence can compensate for high frequency basis weight variations due to its proximity to the system elements being controlled (e.g., headbox and forming elements) and the wet end sensor response. The second control loop includes a dry end measurement sensor and a second controller responsive to the dry end sensor measurements. The second control loop has a slower response time relative to the first control loop since the dry end measurement sensor resides farther down the sheetmaking machine processing path. The second loop compensates for larger basis weight variations so as to keep end product basis weight within a set range. In one embodiment, the first and second controllers adjust operating variables by controlling various aspects of wetstock source, headbox and forming elements of the sheetmaking machine and in particular provide on-line control for controlling headbox pressure, headbox flow, headbox total dilution flow, headbox air pad, jet-to-wire ratio, forming board machine direction location, and forming board angle relative to wire, and refiner loading.

BRIEF DESCRIPTION OF THE DRAWINGS

The present invention may be further understood from the following written description in conjunction with the appended drawings. In the drawings.

DETAILED DESCRIPTION OF THE PREFERRED EMBODIMENTS

Figure 1:
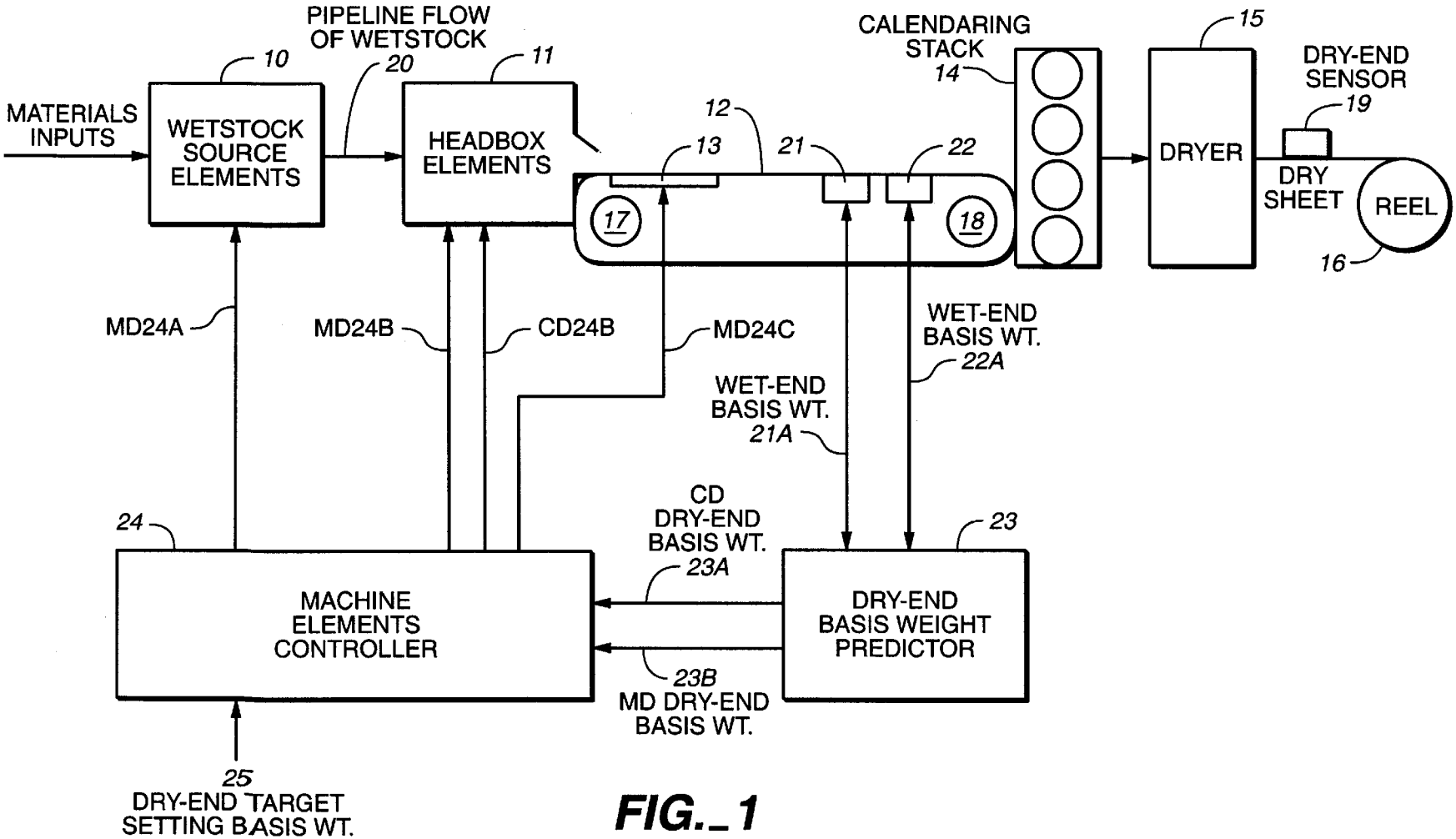
FIG. 1 is a sheetmaking machine including one embodiment of the control system of the present invention.

FIG. 1 shows a sheetmaking machine for producing a continuous sheet of material that comprises processing stages including wetstock source elements 10, headbox 11, web or wire 12, forming board 13, calendaring stack 14, dryer 15, and reel 16. Actuators (not shown) in headbox 11 discharge wetstock (e.g., pulp slurry) through a plurality of orifices referred to as slices onto supporting wire 12 which rotates between rollers 17 and 18. The speed at which the stock is discharged from the slice is called the slice jet velocity. The slice is completely adjustable to give the desired rate of stock flow. The slice geometry and opening determine the thickness of the slice jet, while the headbox pressure determines the velocity. Foils and vacuum boxes (not shown) remove water, commonly known as "white water", from the wetstock on the wire into a wire pit (not shown) for recycle.

Dry end BW measurements can be performed using scanning sensor 19 or using a $UW^3$ sensor. A scanning sensor 19 continuously traverses the finished sheet (e.g., paper) and measures properties to monitor the quality of the finished sheet. Multiple stationary sensors could also be used. Scanning sensors are known in the art and are described, for example, in U.S. Pat. Nos. 5,094,535, 4,879,471, 5,315,124, and 5,432,353, which are incorporated herein. The finished sheet is then collected on reel 16.

When the $UW^3$ sensor is employed, it is positioned next to the reel and underneath the paper. In the case of dry end reel measurements, the $UW^3$ sensor is measuring the dielectric constant of the paper. When using either a scanning or $UW^3$ sensor, the detected electrical signals from the sensor is correlated to a dry end BW measurement. As is apparent, the dry end BW is essentially equal to the dry weight of the paper produced.

The headbox functions to take the stock delivered by a fan pump (not shown) and transform a pipeline flow 20 fed into the headbox from wetstock source elements 10 into an even rectangular discharge equal in the width to the paper machine and at uniform velocity in the machine direction. The operating variables of the headbox determine the evenness of the spread of stock across the width of the machine, the cross-currents and stock consistency variations, the machine direction velocity gradients, the induced turbulence for minimizing floccing of fiber particles, and the angle and location at which the stock is discharged onto the wire. Some headbox operating variables that can be adjusted/controlled to ensure proper paper formation include stock consistency and dilution, headbox pressure, and jet-to-wire speed ratio.

Stock consistency is set low enough to achieve good sheet formation, without compromising first pass-retention or exceeding the drainage capability of the forming section. Consistency is varied by raising and lowering the slice opening. Since the wetstock material addition rate is typically controlled only by the basis weight valve (not shown) which feeds the headbox, a change in slice opening mainly affects the amount of white water circulated from the wire pit. Consistency can also be varied by adjusting total headbox dilution. In the formation process of the paper, the stock in the headbox is diluted so as to obtain a desired consistency which increases sheet uniformity and minimizes clumping (referred to as floccing) of fiber particles during the sheet formation process. The desired consistency of the wetstock can be achieved by diluting the wetstock with recycled water that has drained from the wire during the formation process (referred to as white water). The uniformity of the dilution directly influences the uniformity of the sheet in the machine direction.

The ratio of jet velocity to wire velocity is usually adjusted near unity to achieve best sheet formation. If the jet velocity lags the wire, the sheet is said to be "dragged"; if the jet velocity exceeds the wire speed, the sheet is said to be "rushed". Sometimes, it is necessary to rush or drag the sheet slightly to improve drainage or change fiber orientation. The jet speed is not actually measured, but is inferred from the headbox pressure. The jet-to-wire ratio can be changed by adjusting the wire speed or the jet speed. The wire speed is typically adjusted by changing the speed of the large rolls (17 and 18) at the beginning and end of the wire which the wire travels on. Often times the couch roll, (i.e., the end roll) controls the speed of the wire. The jet speed is adjusted by the headbox pressure.

Headbox pressure and consequently jet speed is adjusted depending on headbox type. Specifically, open headboxes (i.e., non pressurized) rely on the height of the stock in the box to determine the pressure and hence the jet speed. Pressurized headboxes are adjusted differently than open boxes. There are at least two types of pressurized-type headboxes including hydraulic and air cushioned. The pressure in the hydraulic pressurized headbox is directly dependent on the feeding pump pressure and hence headbox pressure is adjusted by changing the pump pressure. In an air cushioned pressurized headbox, the pressure is dependent on the feeding pump pressure as well as the air in the space above the stock (referred to as the "air pad") in the closed headbox. Hence, one manner in which to affect the discharge from the headbox and hence the formation process in the sheetmaking machine is to adjust headbox pressure and jet speed. In the prior art, the "air pad" is adjusted by opening a regulator value to allow more air to enter or by increasing the level of the stock.

In addition to adjusting headbox operating variables to affect sheet formation, the operating variables of the forming board 13 can also be adjusted. In some sheetmaking machines, forming boards immediately following the headbox in the process. The forming board supports the wire at the point of jet impingement. In general, the forming board serves to retard initial drainage so that additives (e.g., fines and fillers) are not washed away through the wire. As a result, the length of the board, the angle of the board with respect to the wire, and the point at which the jet impinges the board all determine the amount of time the stock travels on the board, the amount of liquid initially drained away, and the amount of materials that are washed away with the liquid prior to reaching the wire all of which impact the formation of the sheet on the wire.

It should be understood that although the invention will be described as part of a fourdrinier sheetmaking machine, the invention is applicable to other sheetmaking machines including, for example, twin wire and multiple headbox machines and to paperboard formers such as cylinder machines or Kobayshi Formers. Some conventional elements of a sheetmaking machine are omitted in the following disclosure in order not to obscure the description of the elements of the present invention.

The present invention is a system and method of providing high frequency on-line control of operating variables of sheetmaking machine elements by employing a plurality of sensors that provide multiple point simultaneous wet end water weight measurements independently in either/or both the machine direction (MD) and the cross direction (CD) in the wet end of a sheetmaking machine. The plurality of sensors detect changes in physical properties of a wetstock suspension which travels on a wire in the machine direction of the sheetmaking machine. The changes in detected physical properties are converted to wetstock water weight measurements which, in turn, are converted into predicted basis weight measurements of the final paper product. The predicted basis weight measurements are used to control operating variables of machine elements in the sheetmaking machine to optimize final paper product quality. The advantage of using sensors that provide simultaneous multiple point cross and machine direction measurements is that the CD and MD measurements are not inter-related since scanning is not performed. In addition, the water weight sensors are positioned in the wet end of the sheetmaking machine, close to headbox and forming elements, so as to provide fast feedback of predicted basis weight variations which are used to control machine elements such as headbox and forming elements. Moreover, the sensors have a quick response time (1 msec) so that an essentially instantaneous MD or CD profile of water weight can be obtained.

FIG. 1 shows sensors 21 and 22 positioned in the wet end of the system. It should be noted that the position of the sensors shown in FIG. 1 relative to the wire 12 between rolls 17 and 18 is not indicative of a specific placement. Instead, the sensor can be placed anywhere along the wire in which the wetstock is in a state such that all or most of the water is held by the fiber in the wetstock. Sensors can be arranged into an array of sensor cells or individually in either of the cross or machine directions. For instance, the basis weight at the wet end can be measured with a CD array, further described herein, of the $UW^3$ sensor. Each sensor cell in the array is positioned below a portion of the wire in the cross direction which supports the wetstock. The array provides a continuous measurement of the entire sheet material along the CD direction at the point where it passes the array. A profile made up of a multiplicity of water weight measurements at different locations in the CD is developed. In one embodiment, an average of these measurements is obtained and converted to the wet end basis weight. In one embodiment, the array is imbedded in a sheetmaking machine foil.

Alternatively, an MD basis weight measurement can be obtained using individual sensors arranged along the machine direction of the sheetmaking machine to provide a water weight profile made up of a multiplicity of water weight measurements at different locations in the MD. Although, in theory, it may be possible to place a continuous array of MD sensors in the sheetmaking machine, other elements along the machine direction of a typical sheetmaking machine generally prohibit the placement of a continuous array (such as an array imbedded in a foil). However, it should be understood that an MD sensor array could be used in the case in which the system is designed to accommodate an MD sensor array. Both the CD and MD sensors are preferably positioned upstream from a dry line that forms on the wire.

It should be noted that the term "water weight" refers to the mass or weight of water per unit area of the wet paper stock which is on the wire. Typically, the $UW^3$ sensors when positioned under the wire are calibrated to provide engineering units of grams per square meter (gsm). As an approximation, a reading of 10,000 gsm corresponds to paper stock having a thickness of 1 cm on the fabric. The term "basis weight" or "BW" refers to the total weight of the material per unit area. The term "dry weight" or "dry stock weight" refers to the weight of a material (excluding any weight due to water) per unit area.

Sensors 21 and 22 detect changes in properties of the material being sensed via electrical signal measurements and in particular conductivity measurements. The detected electrical measurements are correlated into changes in wet end BW. A functional relationship between wet end BW and predicted dry end BW allows dry end BW predictor 23 to process water weight measurements made by sensors 21 and 22 to predict what the dry basis weight or dry stock weight would be when it reaches the dry end. Since independent CD and MD measurements are provided, predictor 23 is able to provide separate CD and MD predicted dry end basis weight signals 23A and 23B to machine element controller 24. The predicted dry basis weight (signals 23A and 23B) are compared to a target setting 25 to obtain an error signal, if any, by machine element controller 24. The error signal is used to determine control signals MD24A, MD24B, CD24B, and MD24C for controlling machine elements such as wetstock source elements 10, headbox elements 11, and forming board 13 in the system to compensate for BW variations. Note, the prefix "MD" indicates that a control signal from controller 24, such as "MD"24A, is a machine direction control signal for controlling operating variables that affect MD dry end basis weight whereas the prefix "CD" indicates that the control signal is a cross direction control signal for controlling operating variables that affect CD dry end basis weight.

FIG. 1 shows that machine element controller 24 provides one or two signals to each element to be controlled which depends on whether the element has operating variables that can affect either/or both of the MD and CD basis weight.

In one embodiment, signals provided by controller 24 can be coupled to a means for converting these control signals into electro-mechanical control signals to make the adjustments to each machine element to adjust the elements operating variable(s) to affect one of the CD or MD dry end basis weight. For instance, a control signal from controller 24 for adjusting headbox pressure might be converted into a valve adjustment signal to open or close a pressure valve to increase or decrease MD dry end basis weight. However, it should be understood in FIG. 1 this conversion is performed within controller 24. In the embodiment shown in FIG. 1, control signal MD24A is coupled to the wetstock source elements 10. Any adjustments to operating variables of machine elements at this point of the sheetmaking process will only affect machine direction basis weight since this portion of the system does not affect the manner in which the wetstock is discharged in the cross-direction onto the wire 12. The type of operating variables controlled by signal MD24A depends on the machine element that the control signal is coupled to. In one embodiment, a refining stage can be controlled by adjusting the specific energy, i.e., the amount of energy expended per unit of production (in units of megajoules per kilogram) of a primary or secondary refiner. Specific energy is adjusted by controlling the refiner motor load control signal.

It should be noted that in general a CD control signal provided by controller 24 (e.g., CD24B) represents more than one signal for controlling a machine element at multiple points across the CD in order to independently affect CD basis weight at various points along the CD. As such, the number of CD control signals depends on the number of elements in the CD that a particular machine element includes to be adjusted. For instance, if CD control signals are used to adjust slice opening, then the number of control signals would equal the number of slices. However, a MD control signal provided by controller 24 (e.g. MD24B) in general represents a single signal.

As described herein, headbox operating variables that can be adjusted to affect either CD and MD dry end basis weight include headbox pressure, headbox flow, headbox total dilution flow, headbox air pads, and jet-to-wire ratio. In one embodiment control signal CD24B is provided to headbox slices to affect CD basis weight. In this case, control signal CD24B represents a plurality of control signals for independently adjusting each of the plurality of slices to control CD basis weight. In one embodiment, the plurality of headbox slices each have associated actuators which are controlled by each of the control signals which adjust the slice opening size thereby independently adjusting the dilution of the wetstock in the CD direction for each slice segment and hence dry end CD basis weight. In another embodiment, CD basis weight can be adjusted by controlling the angle at which wetstock is discharged from each slice in a similar manner. Specifically, actuators associated with each slice which adjust slice wetstock discharge angle can be controlled by CD24B.

In another embodiment headbox pressure is adjusted to affect dry end MD basis weight. Specifically, headbox pressure determines the velocity at which the wetstock is discharged from the headbox. Headbox pressure can be adjusted in two manners depending on headbox type. Specifically, open headboxes (i.e., non pressurized) rely on the height of the stock in the box to determine the pressure and hence the jet speed. Hence, in this case control signal MD24B would be used to control the level of wetstock in the headbox.

To adjust the pressure in the hydraulic pressurized headbox, control signal MD24B is converted into a control signal that changes the pump speed which in turn changes pump pressure of the feeding pump. Pressure in an air cushioned pressurized headbox can be adjusted in at least two manners. First, the speed of the pump and hence the pump pressure of the feeding pump can be adjusted and controlled using control signal MD24B as describe for the hydraulic headbox. Second, the air in the space above the wetstock (referred to as the "air pad") can be adjusted by adjusting a regulator valve to allow more air to enter or escape. Hence, in this case, control signal MD24B is used to control the opening or closing of the headbox pressure valve.

As described above, CD24B provides control to headbox slices so as to determine the manner in which each slice discharges the stock by adjusting slice opening or angle. In a similar manner, the MD24B signal performs a gross slice opening adjustment. In other words, control signal MD24B is coupled to all of the slice opening actuators or angle actuators so as to open or close all slices by the same amount or adjust the angle of all slices by the same amount.

In another embodiment, control signal MD24B is used to control headbox total dilution flow by diluting the wetstock with recycled water that has drained from the wire during the formation process. In this case control signal MD24B controls a white water intake valve which determines the amount of white water routed from the wire pit under the wire which is used to dilute the wetstock in the headbox.

In another embodiment, the jet-to-wire ratio is adjusted by adjusting headbox pressure as described above or by adjusting wire speed. In this case, MD24B is coupled to (not shown in FIG. 1) and provides control to the electro-mechanical control system for driving rolls 17 and 18 so as to adjust the driver speed.

In another embodiment, the forming board MD location is adjusted in a forward or backward MD direction relative to the headbox jet. Moving the forming board in this manner determines the amount of board that the wetstock travels on prior traveling directly on the wire. For instance, if the forming board is moved forward in the machine direction the wetstock is on the forming board for a longer processing interval whereas if the forming board is moved backward in the machine direction, the wetstock is on the forming board for shorter processing period. The length at which the wetstock resides on the forming board affects paper characteristics such as basis weight, strength, and formation. In one embodiment, rapid hydraulic pistons coupled to the forming board can be controlled by control signal MD24C to control dry end basis weight and formation qualities.

In a similar manner, forming board angle relative to the jet and wire can be adjusted. In this case, formation, basis weight, drainage can be affected by whether the forming board is tilted towards the headbox so that drainage occurs in the direction of the headbox or whether the forming board is tilted away from the headbox so that the majority of the drainage occurs in the direction away from the headbox. The forming board angle can be mechanically adjusted by using rapid hydraulic pistons situated on either side of the forming board and responsive to the MD24C signal in a similar manner as described above.

It should be noted that in prior art systems, forming boards are generally adjusted and set at the beginning of a process run. However, these prior art system designs do not provide for the capability of performing online forming board adjustments using hydraulic pistons in accordance with the above embodiments.

Figure 2:
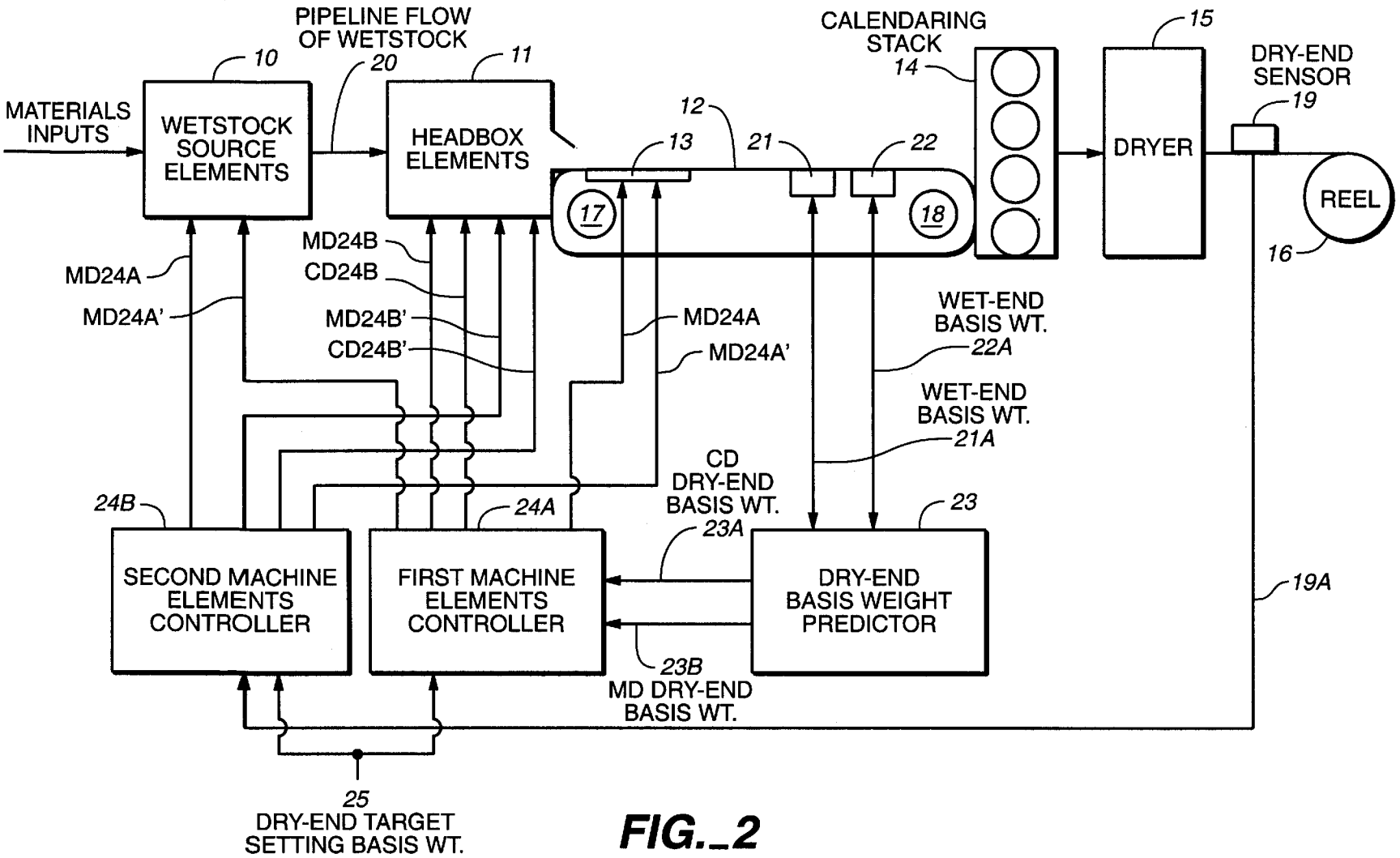
FIG. 2 is a sheetmaking machine including another embodiment of the control system of the present invention.

FIG. 2 shows a second embodiment of a control system for a sheetmaking machine which includes wetstock source elements 10, headbox elements 11, wire 12, forming board 13, rollers 17 and 18, calendering stack 14, dryer 15, and reel 19 as shown in FIG. 1. The control system includes a first control loop including wet end sensors 21 and 22, dry end basis weight predictor 23, and first machine element controller 24A as described in conjunction with FIG. 1 and also includes a second control loop including dry end sensor 19 and second machine elements controller 24B. The first controller in response to predicted dry end basis weight signals 23A and 23B and dry end target setting basis weight 25 and provides signals MD24A, MD24B and CD24B, and MD24C for controlling machine elements 10, 11, and 13. The second controller in response to measured dry end basis weight signal 19A and dry end target setting basis weight 25 provides control signals MD24A', MD24B' and CD24B', and MD24C' for controlling machine elements 10, 11, and 13. In accordance with this embodiment, the first loop has a fast response time due to the proximity of the sensors to the wetstock source elements 10, headbox elements 11, and forming board 13 and the response time of the sensors 21 and 22 and hence provides fast control to adjust operating variables of the machine elements and the second loop has a relatively slower response time due to its proximity to the wetstock source elements 10, headbox elements 11, and forming board 13 hence provides slower control to adjust operating variables of the machine elements. It should be noted that in the case in which sensor 19 is a scanning type sensor, in order to obtain both MD and CD dry basis weight measurements, several scans need to be taken and processed to provide estimated dry end MD and CD basis weight measurements. Hence, in this embodiment, the second control loop includes a data processing stage for converting the scanned dry end basis weight into estimated dry end MD and CD basis weight.

In one embodiment of the control system shown in FIG. 2, at least one operating variable of a machine element is controlled by the control signal from the first and second controllers. For instance, the gross slice opening may be controlled by adjusting slice opening to open or close. In one embodiment, a first fast actuator responsive to first control signals controls the machine elements to adjust operating variables and a second slower actuator responsive to second control signals control the machine elements to adjust operating variables. Since, the wet end BW sensor detects fluctuations in the basis weight much earlier than the dry end BW sensor, small fluctuations tend to be detected by the wet end sensor and larger fluctuations are detected by the dry end sensor. Consequently, the first actuator functions to perform fine machine element adjustments while the second actuator performs coarse adjustments. Furthermore, the first faster loop is influenced by the dynamics of the second slower loop since the faster loop may adjust BW sufficiently so that no BW fluctuations are seen at the dry end and hence the slower loop need not respond.

Under Wire Water Weight ($UW^3$) Sensor

Figure 3B:
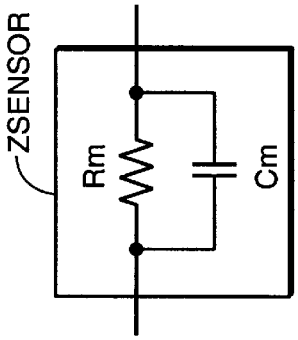
FIG. 3B is an electrical representation of sensor cell impedance.
Figure 3A:
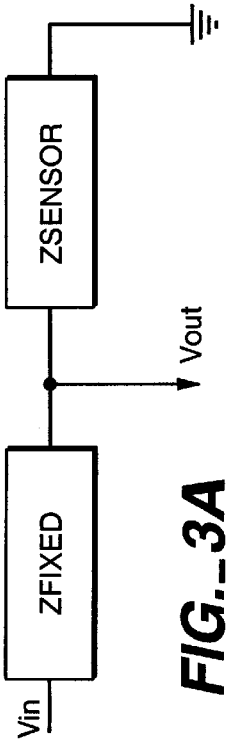
FIG. 3A is a block diagram illustrating impedance in the measurement apparatus.

In its broadest sense, the sensor can be represented as a block diagram as shown in FIG. 3A, which includes a fixed impedance element (Zfixed) coupled in series with a variable impedance block (Zsensor) between an input signal (Vin) and ground. The fixed impedance element may be embodied as a resistor, an inductor, a capacitor, or a combination of these elements. The fixed impedance element and the impedance, Zsensor, form a voltage divider network such that changes in impedance, Zsensor, results in changes in voltage on Vout. The impedance block, Zsensor, shown in FIG. 3A is representative of two electrodes and the material residing between the electrodes. The impedance block, Zsensor, can also be represented by the equivalent circuit shown in FIG. 3B, where Rm is the resistance of the material between the electrodes and Cm is the capacitance of the material between the electrodes. The sensor is further described in U.S. Pat. application Ser. No. 08/766,864 filed on Dec. 13, 1996, which is incorporated herein.

As described above, wet end BW measurements can be obtained with one or more $UW^3$ sensors. Moreover, when more than one is employed, preferably the sensors are configured in an array of sensor cells. However, in some cases when an array does not physically fit in a location in the sheetmaking machine, a single sensor cell may be employed.

The sensor is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e. $Rm=\infty$) between the electrodes and the sensor measures the dielectric constant of the material. In the case of highly conductive material, the resistance of the material is much less than the capacitive impedance (i.e. $Rm \ll Z_{Cm}$), and the sensor measures the conductivity of the material.

To implement the sensor, a signal Vin is coupled to the voltage divider network shown in FIG. 3A and changes in the variable impedance block (Zsensor) is measured on Vout. In this configuration the sensor impedance, Zsensor, is: Zsensor=Zfixed*Vout/(Vin−Vout) (Eq. 1). The changes in impedance of Zsensor relates physical characteristics of the material such as material weight, temperature, and chemical composition. It should be noted that optimal sensor sensitivity is obtained when Zsensor is approximately the same as or in the range of Zfixed.

Cell Array

Figure 4:
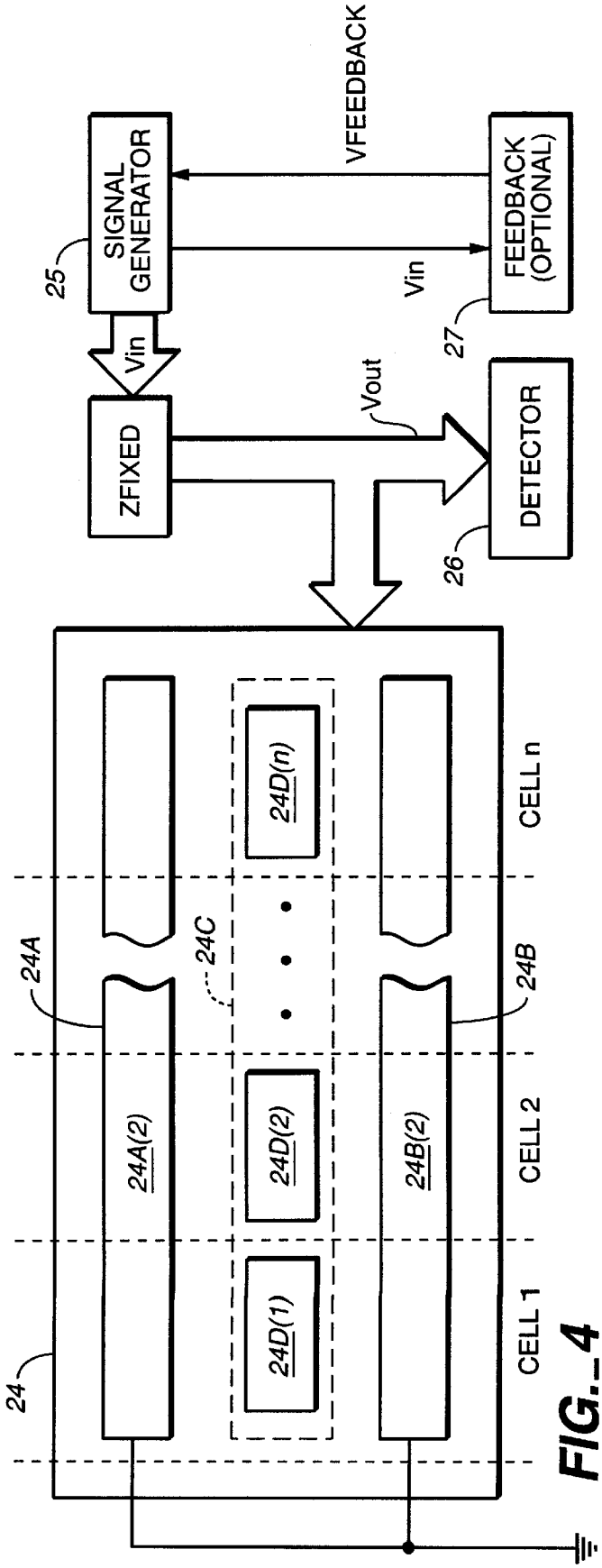
FIG. 4 shows a block diagram of a measurement apparatus including a sensor array in accordance with the present invention.

FIG. 4 illustrates a block diagram of one implementation of the sensor apparatus including cell array 24, signal generator 25, detector 26, and optional feedback circuit 27. Cell array 24 includes two elongated grounded electrodes 24A and 24B and center electrode 24C spaced apart and centered between electrodes 24A and 24B and made up of sub-electrodes 24D(1)–24D(n). A cell within array 24 is defined as including one of sub-electrodes 24D situated between a portion of each of the grounded electrodes 24A and 24B. For example, cell 2 includes sub-electrode 24D(2) and grounded electrode portions 24A(2) and 24B(2). For use in the system as shown in FIGS. 1 and 2, cell array 24 resides beneath and in contact with supporting web 12 and can be positioned either parallel to the machine direction (MD) or to the cross-direction (CD) depending on the type of information that is desired. In order to use the sensor apparatus to determine the weight of fiber in a wetstock mixture by measuring its conductivity, the wetstock must be in a state such that all or most of the water is held by the fiber. In this state, the water weight of the wetstock relates directly to the fiber weight and the conductivity of the water weight can be measured and used to determine the weight of the fiber in the wetstock.

Each cell is independently coupled to an input voltage (Vin) from signal generator 25 through an impedance element Zfixed and each provides an output voltage to voltage detector 26 on bus Vout. Signal generator 25 provides Vin. In one embodiment Vin is an analog waveform signal, however other signal types may be used such as a DC signal. In the embodiment in which signal generator 25 provides a waveform signal it may be implemented in a variety of ways and typically includes a crystal oscillator for generating a sine wave signal and a phase lock loop for signal stability. One advantage to using an AC signal as opposed to a DC signal is that it may be AC coupled to eliminate DC off-set.

Detector 26 includes circuitry for detecting variations in voltage from each of the sub-electrodes 24D and any conversion circuitry for converting the voltage variations into useful information relating to the physical characteristics of the aqueous mixture. Optional feedback circuit 27 includes a reference cell also having three electrodes similarly configured as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in water weight, the reference cell is configured so that it measures a constant water weight. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). The non-weight related aqueous mixture conductivity information provided by the reference cell may also provide useful data in the sheetmaking process.

Individual cells within sensor 24 can be readily employed in the system of FIGS. 1 and 2 so that each of the individual cells (1 to n) corresponds to each of the individual $UW^3$ sensors in the machine or cross direction. The length of each sub-electrode (24D (n)) determines the resolution of each cell. Typically, its length ranges from 1 in. to 6 in.

The sensor cells are positioned underneath the web, preferably upstream of the dry line, which on a fourdrinier, typically is a visible line of demarcation corresponding to the point where a glossy layer of water is no longer present on the top of the stock.

A method of constructing the array is to use a hydrofoil or foil from a hydrofoil assembly as a support for the components of the array. In a preferred embodiment, the grounded electrodes and center electrodes each has a surface that is flushed with the surface of the foil.

Figure 5A:
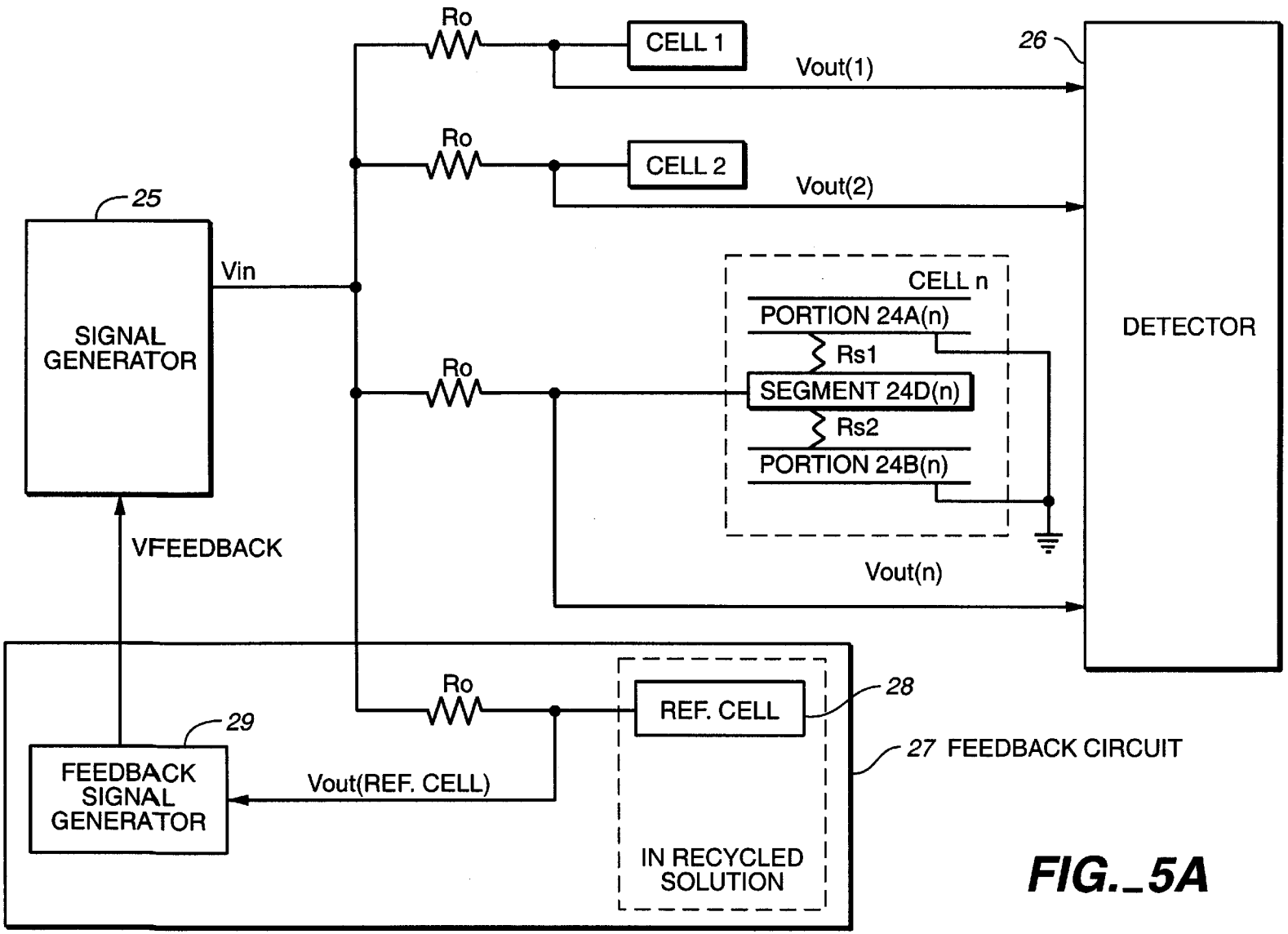
FIG. 5A shows an electrical representation of the block diagram shown in FIG. 4.
Figure 5B:
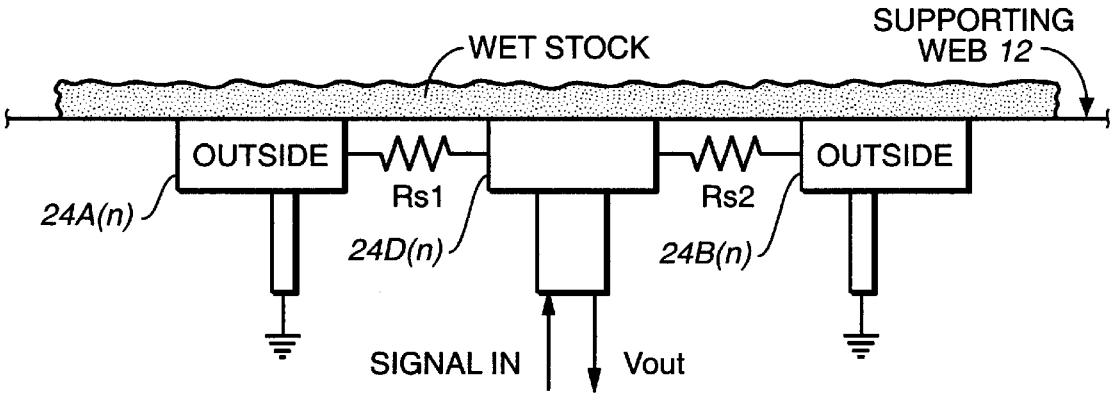
FIG. 5B shows a single sensor cell residing beneath a sheetmaking machine supporting web in accordance with the measurement apparatus of the present invention.

FIG. 5A shows an electrical representation of sensor cell array 24 (including cells 1–n) and the manner in which it functions to sense changes in conductivity of an aqueous mixture (i.e., wetstock). As shown, each cell is coupled to Vin from signal generator 25 through an impedance element which, in this embodiment, is resistive element Ro. Referring to cell n, resistor Ro is coupled to the center sub-electrode 24D(n). The outside electrode portions 24A(n) and 24B(n) are both coupled to ground. Also shown in FIG. 5A are resistors Rs1 and Rs2 which represent the conductance of the aqueous mixture between each of the outside electrodes and the center electrode. The outside electrodes are designed to be essentially equidistant from the center electrode and consequently the conductance between each and the center electrode is essentially equal (Rs1=Rs2=Rs). As a result, Rs1 and Rs2 form a parallel resistive branch having an effective conductance of half of Rs (i.e. Rs/2). It can also be seen that resistors Ro, Rs1, and Rs2 form a voltage divider network between Vin and ground. FIG. 5B also shows the cross-section of one implementation of a cell electrode configuration with respect to a sheetmaking machine in which electrodes 24A(n), 24B(n), and 24D(n) reside directly under the web 12 immersed within the aqueous mixture.

The sensor apparatus is based on the concept that the resistance Rs of the aqueous mixture and the weight/amount of an aqueous mixture are inversely proportional. Consequently, as the weight increases/decreases, Rs decreases/increases. Changes in Rs cause corresponding fluctuations in the voltage Vout as dictated by the voltage divider network including Ro, Rs1, and Rs2.

The voltage Vout from each cell is coupled to detector 26. Hence, variations in voltage directly proportional to variations in resistivity of the aqueous mixture are detected by detector 26 thereby providing information relating to the weight and amount of aqueous mixture in the general proximity above each cell. Detector 26 may include means for amplifying the output signals from each cell and in the case of an analog signal will include a means for rectifying the signal to convert the analog signal into a DC signal. In one implementation well adapted for electrically noisy environments, the rectifier is a switched rectifier including a phase lock-loop controlled by Vin. As a result, the rectifier rejects any signal components other than those having the same frequency as the input signal and thus provides an extremely well filtered DC signal. Detector 26 also typically includes other circuitry for converting the output signals from the cell into information representing particular characteristics of the aqueous mixture such as weight.

FIG. 5A also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if water weight is desired to be sensed then the water weight is kept constant so that any voltage changes generated by the reference cell are due to physical characteristics other than water weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, not the weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 6A:
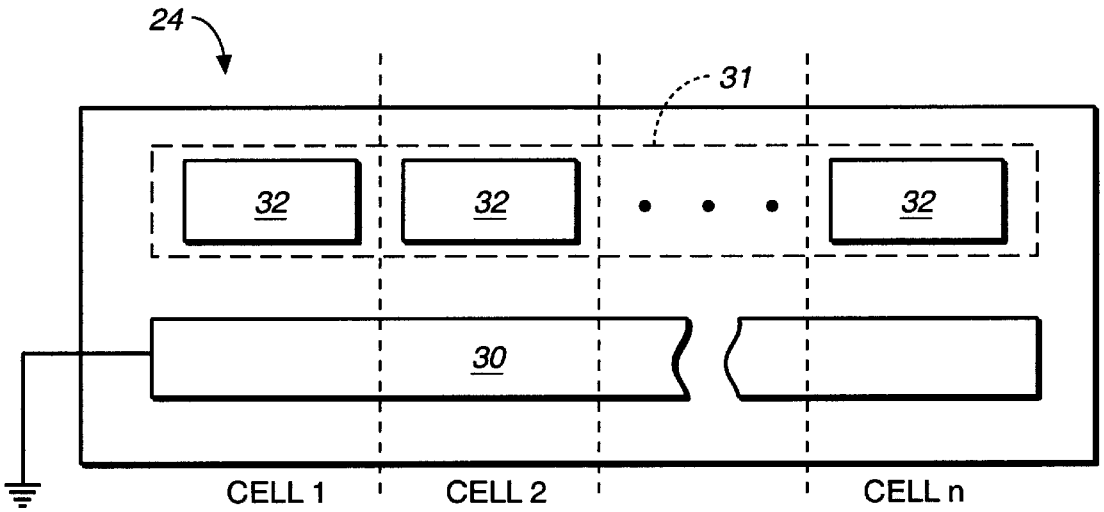
FIGS. 6A and 6B show a second embodiment of a sensor array and an equivalent electrical representation.
Figure 6B:
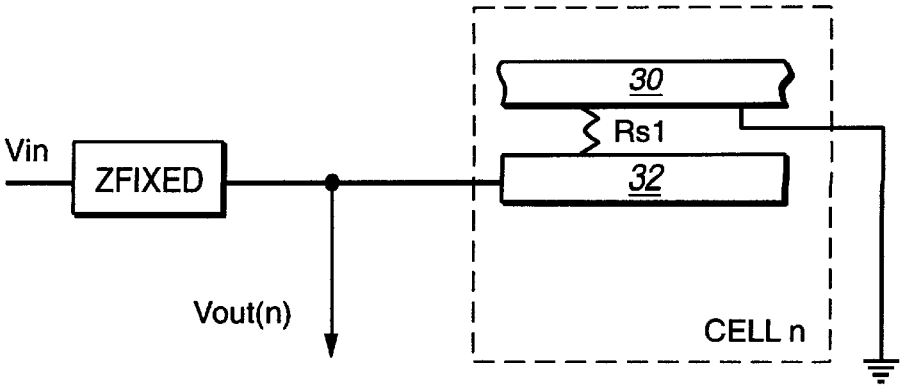

One reason for configuring the cell array as shown in FIG. 5A, with the center electrode placed between two grounded electrodes, is to electrically isolate the center electrode and to prevent any outside interaction between the center electrode and other elements within the system. However, it should also be understood that the cell array can be configured with only two electrodes. FIG. 6A shows a second embodiment of the cell array for use in the sensor. In this embodiment, the sensor includes a first grounded elongated electrode 30 and a second partitioned electrode 31 including sub-electrodes 32. A single cell is defined as including one of the sub-electrodes 32 and the portion of the grounded electrode 30 which is adjacent to the corresponding sub-electrode. FIG. 6A shows cells 1–n each including a sub-electrode 32 and an adjacent portion of electrode 30. FIG. 6B shows a single cell n, wherein the sub-electrode 32 is coupled to Vin from the signal generator 25 through a fixed impedance element Zfixed and an output signal Vout is detected from the sub-electrode 32. It should be apparent that the voltage detected from each cell is now dependent on the voltage divider network, the variable impedance provided from each cell and the fixed impedance element coupled to each sub-electrode 32. Hence, changes in conductance of each cell is now dependent on changes in conductance of Rs1. The remainder of the sensor functions in the same manner as with the embodiment shown in FIG. 6A. Specifically, the signal generator provides a signal to each cell and feedback circuit 27 compensates Vin for variations in conductance that are not due to the characteristic being measured.

Figure 7A:
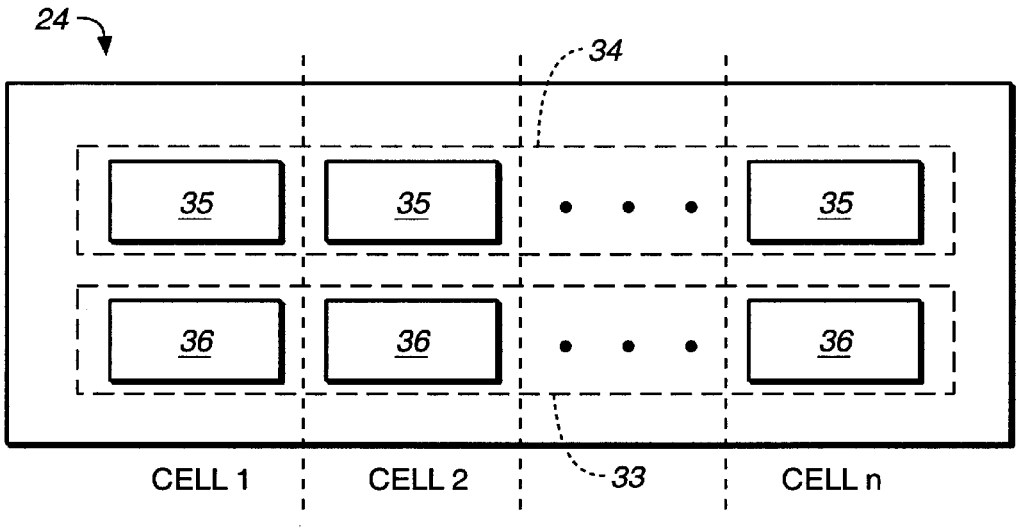
FIGS. 7A and 7B show a third embodiment of a sensor array and an equivalent electrical representation.
Figure 7B:
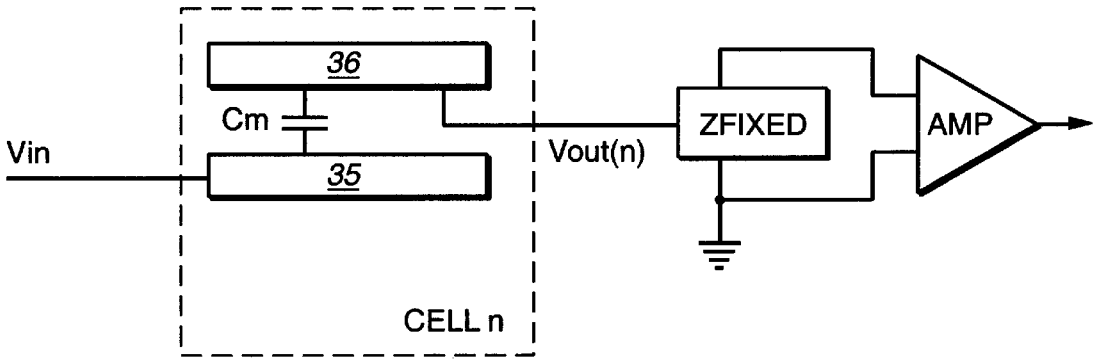

In still another embodiment of the cell array shown in FIGS. 7A and 7B, the cell array includes first and second elongated spaced apart partitioned electrodes 33 and 34, each including first and second sets of sub-electrodes 36 and 35, (respectively). A single cell (FIG. 7B) includes pairs of adjacent sub-electrodes 35 and 36, wherein sub-electrode 35 in a given cell is independently coupled to the signal generator and sub-electrode 36 in the given cell provides Vout to a high impedance detector amplifier which provides Zfixed. This embodiment is useful when the material residing between the electrodes functions as a dielectric making the sensor impedance high. Changes in voltage Vout is then dependent on the dielectric constant of the material. This embodiment is conducive to being implemented at the dry end of a sheetmaking machine (and particularly beneath and in contact with the dry sheet since dry paper has high resistance and its dielectric properties are easier to measure.

Predicting Dry End Basis Weight from Measurements of $UW^3$ Sensors

The following describes a preferred method of predicting the dry stock weight using the $UW^3$ sensors. In particular, the paper produced involves simultaneous measurements of (1) the water contents of the paper stock on the fabric or wire of the papermaking machine at three or more locations along the machine direction of the fabric and of (2) the dry stock weight of the paper product preceding the paper stock on the fabric. In this fashion, the expected dry stock weight of the paper that will be formed by the paper stock on the fabric can be determined at that instance.

Specifically, the method of predicting the dry stock weight of a sheet of material that is moving on a water permeable fabric of a de-watering machine that includes the steps of:

a) placing three or more water weight sensors adjacent to the fabric wherein the sensors are positioned at different locations in the direction of movement of the fabric and placing a sensor to measure the moisture content of the sheet of material after being substantially de-watered;

b) operating the machine at predetermined operating parameters and measuring the water weights of the sheet of material at the three or more locations on the fabric with the water weight sensors and simultaneously measuring the dry weight apart of the sheet of material that has been substantially de-watered;

c) performing bump tests to measure changes in water weight in response to perturbations in three or more operating parameters wherein each bump test is performed by alternately varying one of the operating parameters while keeping the others constant, and calculating the changes in the measurements of the three or more water weight sensors and wherein the number of bump tests correspond to the number of water weight sensors employed;

d) using said calculated changes in the measurements from step c) to obtain a linearized model describing changes in the three or more water weight sensors as a function of changes in the three or more operating parameters about said predetermined operating parameters wherein this function is expressed as an N×N matrix wherein N is equal to the number of water weight sensors employed; and e) developing a functional relationship between water weight measurements from the three or more water weight sensors for a segment of the moving sheet of material at the fabric and the predicted moisture level for the segment after being substantially de-watered.

Preferably, the bump tests comprise varying the flow rate of the aqueous fiber stock onto the fabric, freeness of the fiber stock, and concentration of fiber in the aqueous fiber stock. With the present invention, by continuously monitoring the water weight levels of the paper stock on the fabric, it is possible to predict the quality (i.e., dry stock weight) of the product. Furthermore, feedback controls can be implemented to change one or more operating parameters in response to fluctuations in predicted dry stock weight.

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency and wire speed. It has demonstrated that particularly useful drainage profiles can be generated by varying the following process parameters: 1) total water flow which depends on, among other things, the head box delivery system, head pressure and slice opening and slope position, 2) freeness which depends on, among other things, the stock characteristics and refiner power; and 3) dry stock flow and headbox consistency.

Water weight sensors placed at strategic locations along the paper making fabric can be used to profile the de-watering process (hereinafter referred to as "drainage profile"). By varying the above stated process parameters and measuring changes in the drainage profile, one can then construct a model which simulates the wet end paper process dynamics. Conversely one can use the model to determine how the process parameters should be varied to maintain or produce a specified change in the drainage profile. Furthermore with the present invention the dry stock weight of the web on the paper making fabric can be predicted from the water weight drainage profiles.

Three water weight sensors measure the water weight of the paper stock on the fabric. The position along the fabric at which the three sensors are located are designated "h", "m", and "d", respectively, in FIGS. 8 and 9. More than three water weight sensors can be employed. It is not necessary that the sensors be aligned in tandem, the only requirement is that they are positioned at different machine directional positions. Typically, readings from the water weight sensor at location "h" which is closest to the head box will be more influenced by changes in stock freeness than in changes in the dry stock since changes in the latter is insignificant when compared to the large free water weight quantity. At the middle location "m", the water weight sensor is usually more influenced by changes in the amount of free water than by changes in the amount of dry stock. Most preferably location "m" is selected so as to be sensitive to both stock weight and free changes. Finally, location "d", which is closest to the drying section, is selected so that the water weight sensor is sensitive to changes in the dry stock because at this point of the de-water process the amount of water bonded to or associated with the fiber is proportional to the fiber weight. This water weight sensor is also sensitive to changes in the freeness of the fiber although to a lesser extent. Preferably, at position "d" sufficient amounts of water have been removed so that the paper stock has an effective consistency whereby essentially no further fiber loss through the fabric occurs.

In measuring paper stock, the conductivity of the mixture is high and dominates the measurement of the sensor. The proximity is held constant by contacting the support web in the papermaking system under the paper stock. The conductivity of the paper stock is directly proportional to the total water weight within the wetstock, consequently providing information which can be used to monitor and control the quality of the paper sheet produced by the papermaking system. In order to use this sensor to determine the weight of fiber in a paper stock mixture by measuring its conductivity, the paper stock is in a state such that all or most of the water is held by the fiber. In this state, the water weight of the paper stock relates directly to the fiber weight and the conductivity of the water weight can be measured and used to determine the weight of the fiber in the paper stock.

Formulation of Drainage Characteristics Curves

In this particular embodiment of the invention, three water weight sensors are used to measure the dependence of the drainage profile of water from the paper stock through the fabric on three machine operation parameters: (1) total water flow, (2) freeness of paper stock, and (3) dry stock flow or headbox consistency. Other applicable parameters include for example, (machine speed and vacuum level for removing water). For the case of three process parameters the minimum is three water weight sensors. More can be used for more detailed profiling.

A preferred form of modeling uses a baseline configuration of process parameters and resultant drainage profile, and then measures the effect on the drainage profile in response to a perturbation of an operation parameter of the fourdrinier machine. In essence this linearizes the system about the neighborhood of the baseline operating configuration. The perturbations or bumps are used to measure first derivatives of the dependence of the drainage profile on the process parameters.

Once a set of drainage characteristic curves has been developed, the curves, which are presented as a 3×3 matrix, can be employed to, among other things, predict the water content in paper that is made by monitoring the water weight along the wire by the water weight sensors.

Bump Tests

The term "bump test" refers to a procedure whereby an operating parameter on the papermaking machine is altered and changes of certain dependent variables resulting therefrom are measured. Prior to initiating any bump test, the papermaking machine is first operated at predetermined baseline conditions. By "baseline conditions" is meant those operating conditions whereby the machine produces paper. Typically, the baseline conditions will correspond to standard or optimized parameters for papermaking. Given the expense involved in operating the machine, extreme conditions that may produce defective, non-useable paper is to be avoided. In a similar vein, when an operating parameter in the system is modified for the bump test, the change should not be so drastic as to damage the machine or produce defective paper. After the machine has reached steady state or stable operations, the water weights at each of the three sensors are measured and recorded. Sufficient number of measurements over a length of time are taken to provide representative data. This set of steady-state data will be compared with data following each test. Next, a bump test is conducted. The following data were generated on a Beloit Concept 3 papermaking machine, manufactured by Beloit Corporation, Beloit, Wis. The calculations were implemented using a microprocessor using Labview 4.0.1 software from National Instrument (Austin Tex.).

(1) Dry Stock Flow Test

Figure 8:
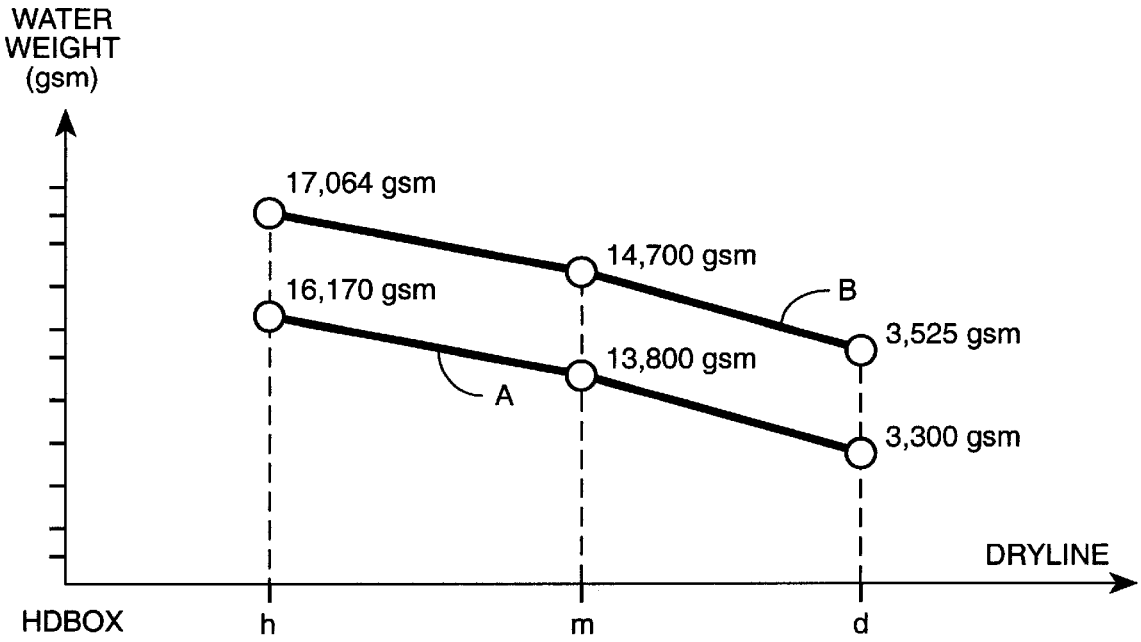
FIG. 8 shows a graph of water weight vs. wire position used in a dry stock bump test.

The flowrate of dry stock delivered to the headbox is changed from the baseline level to alter the paper stock composition. Once steady state conditions are reached, the water weights are measured by the three sensors and recorded. Sufficient number of measurements over a length of time are taken to provide representative data. FIG. 8 is a graph of water weight vs. wire position measured during baseline operations and during a dry stock flow bump test wherein the dry stock was increased by 100 gal/min from a baseline flow rate of 1629 gal/min. Curve A connects the three water weight measurements during baseline operations and curve B connects the measurements during the bump test. As is apparent, increasing the dry stock flow rate causes the water weight to increase. The reason is that because the paper stock contains a high percentage of pulp, more water is retained by the paper stock. The percentage difference in the water weight at positions h, m, and d along the wire are +5.533%, +6.522%, and +6.818%, respectively.

For the dry stock flow test, the controls on the papermaking machine for the basic weight and moisture are switched off and all other operating parameters are held as steady as possible. Next, the stock flow rate is increased by 100 gal/min. for a sufficient amount of time, e.g., about 10 minutes. During this interval, measurements from the three sensors are recorded and the data derived therefrom are shown in FIG. 8.

(2) Freeness Test

Figure 9:
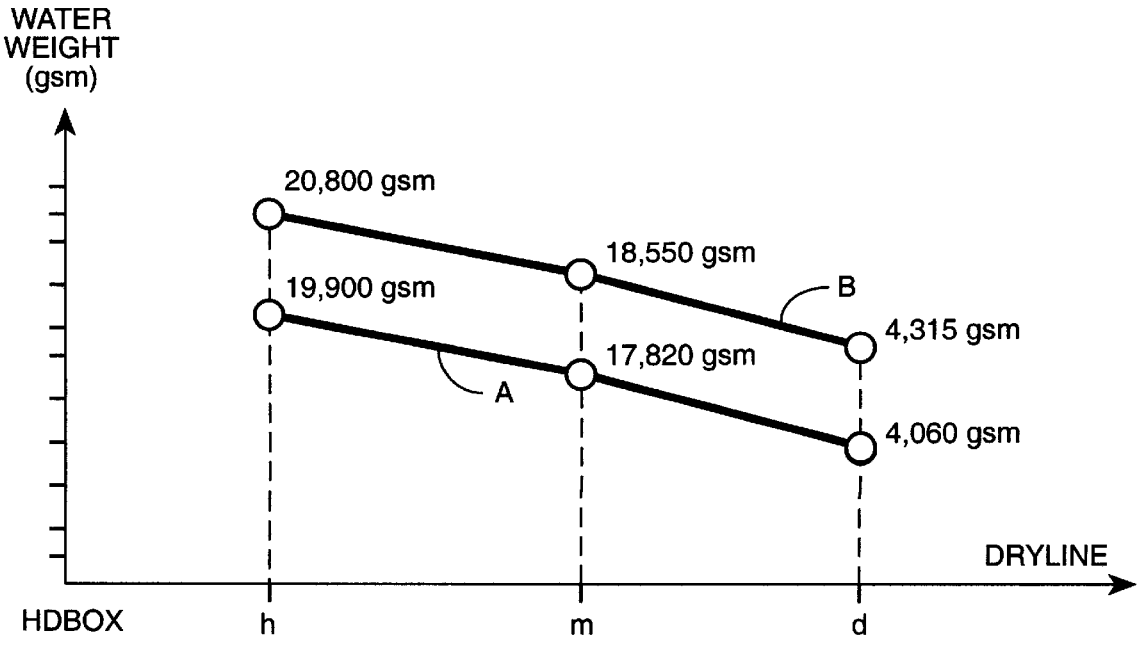
FIG. 9 shows a graph of water weight vs. wire position used in a freeness test.

As described previously, one method of changing the freeness of paper stock is to alter the power to the refiner which ultimately effects the level of grinding the pulp is subjected to. During the freeness test, once steady state conditions are reached, the water weights at each of the three sensors are measured and recorded. In one test, power to the refiner was increased from about 600 kw to about 650 kw. FIG. 9 is a graph of water weight vs. wire position measured during baseline operations (600 kw) (curve A) and during the steady state operations after an additional 50 kw are added (curve B). As expected, the freeness was reduced resulting in an increase in the water weight (FIG. 9, curve B) as in the dry stock flow test. Comparison of the data showed that the percentage difference in the water weight at positions h, m, and d are +4.523%, +4.658%, and +6.281%, respectively.

(3) Total Paper Stock Flow Rate (Slice) Test

One method of regulating the total paper stock flow rate from the head box is to adjust aperture of the slice. During this test, once steady state conditions are reached, the water weights at each of the three sensors are measured and recorded. In one test, the slice aperture was raised from about 1.60 in. (4.06 cm) to about 1.66 in. (4.2 cm) thereby increasing the flow rate. As expected, the higher flow rate increased the water weight. Comparison of the data showed that the percentage difference in the water weight at positions h, m, and d are +9.395%, +5.5%, and +3.333%, respectively. (The measurement at position m of 5.5% is an estimate since the sensor at this location was not in service when the test was performed.)

The Drainage Characteristic Curves (DCC)

From the previously described bump tests one can derive a set of drainage characteristic curves (DCC). The effect of changes in three process parameters on the three water weight sensor values provides nine partial derivatives which form a 3×3 DCC matrix. Generally, when employing n number of water weight sensors mounted on the wire and m bump tests, a n×m matrix is obtained.

Specifically, the 3×3 DCC matrix is given by:

$$DC_{Th}DC_{Tm}DC_{Td}$$

$$DC_{Fh}DC_{Fm}DC_{Fd}$$

$$DC_{Sh}DC_{Sm}DC_{Sd}$$

where T, F, S refer to results from bumps in the total water flow, freeness, and dry stock flow, respectively, and h, m, and d designate the positions of the sensors mounted along the fabric.

The matrix row components $[DC_{Th}DC_{Tm}DC_{Td}]$ are defined as the percentage of water weight change on total water weight at locations h, m, and d based on the total flow rate bump tests. More precisely, for example, "$DC_{Th}$" is defined as the difference in percentage water weight change at position h at a moment in time just before and just after the total flow rate bump test. $DC_{Tm}$ and $DC_{Td}$ designate the values for the sensors located at positions m and d, respectively. Similarly, the matrix row components $[DC_{Fh}DC_{Fm}DC_{Fd}]$ and $[DC_{Sh}DC_{Sm}DC_{Sd}]$ are derived from the freeness and dry stock bump tests, respectively.

Components $DC_{Th}$, $DC_{Fm}$ and $DC_{Sd}$ on the DDC matrix are referred to pivotal coefficients and by Gauss elimination, for example, they are used to identify the wet end process change as further described herein. If a pivot coefficient is too small, the uncertainty in the coefficients will be amplified during the Gauss elimination process. Therefore, preferably these three pivotal coefficients should be in the range of about 0.03 to 0.10 which corresponds to about 3% to 10% change in the water weight during each bump test.

Drainage Profile Change

Based on the DCC matrix, the drainage profile change can be represented as a linear combination of changes in the different process parameters. Specifically, using the DCC matrix, the percentage change in the drainage profile at each location may be computed as a linear combination of the individual changes in the process parameters: total water flow, freeness, and dry stock flow. Thus:

$$\Delta DP\ \%\ (h,t)=DCTh*w+DCFh*f+DCSh*s,$$

$$\Delta DP\ \%\ (m,t)=DCTm*w+DCFm*f+DCSm*s,$$

$$\Delta DP\ \%\ (d,t)=DCTd*w+DCFd*f+DCSd*s,$$

where (w, f, s) refer to changes in total water flow, freeness, and dry stock flow respectively, and the DC's are components of the DCC matrix.

By inverting this system of linear equations, one may solve for the values of (w, f, s) needed to produce a specified drainage profile change (Δ DP % (h), Δ DP % (m), Δ DP % (d). Letting A represent the inverse of the DCC matrix, $$A_{11}A_{12}A_{13}\ \Delta DP\ \%\ (h)\ w$$

$$A_{21}A_{22}A_{23}\ \Delta DP\ \%\ (m)=f$$

$$A_{31}A_{32}A_{33}\ \Delta DP\ \%\ (d)\ s$$

or $$w=A_{11}*\Delta DP\ \%\ (h)+A_{12}*\Delta DP\ \%\ (m)+A_{13}*\Delta DP\ \%\ (d)$$

$$f=A_{21}*\Delta DP\ \%\ (h)+A_{22}*\Delta DP\ \%\ (m)+A_{23}*\Delta DP\ \%\ (d)$$

$$s=A_{31}*\Delta DP\ \%\ (h)+A_{32}*\Delta DP\ \%\ (m)+A_{33}*\Delta DP\ \%\ (d)$$

The above equation shows explicitly how inverting the DCC matrix allows one to compute the (w, f, s) needed to effect a desired change in drainage profile, (Δ DP % (h), Δ DP % (m), Δ DP % (d)).

Empirically, the choice of the three operating parameters, the location of the sensors, and the size of the bumps produces a matrix with well behaved pivot coefficients, and the matrix can thus be inverted without undue noise.

By continuously comparing the dry weight measurement from scanner 19 in FIGS. 1 and 2 with the water weight profiles measured at sensors h, m, and d, one can make a dynamic estimate of the final dry stock weight will be for the paper stock that is at the position of scanner 19.

Dry Stock Prediction

At location d which is closest to the drying section, the state of the paper stock is such that essentially all of the water is held by the fiber. In this state, the amount of water bonded to or associated with the fiber is proportional to the fiber weight. Thus the sensor at location d is sensitive to changes in the dry stock and is particularly useful for predicting the weight of the final paper stock. Based on this proportionality relation: DW(d)=U(d)*C(d), where DW(d) is the predicted dry stock weight at location d, U(d) is the measured water weight at location d and C(d) is a variable of proportionality relating DW to U and may be referred to as the consistency. Further, C(d) is calculated from historical data of the water weight and dry weight measured by the scanning sensor at reel-up.

Subsequent to position d in the papermaking machine (see FIGS. 1 and 2), the sheet of stock exits wire 12 and travels into calendaring stack 14 and dryer 15. At location 19, a scanning sensor measures the final dry stock weight of the paper product. Since there is essentially no fiber loss subsequent to location d, it may be assumed that DW(d) is equal to the final dry stock weight and thus one can calculate the consistency C(d) dynamically.

Having obtained these relations, one can then predict the effect of changes in the process parameters on the final dry stock weight. As derived previously the DCC matrix predicts the effect of process changes on the drainage profile. Specifically in terms of changes in total water flow w, freeness f, and dry stock flow s, the change in U(d) is given by:

$$\Delta U(d)/U(d)=DC_{Td}$$

where Ref(cd) is a dynamic calculated value based on current dry weight sensor and historical water weight sensory readings where the α's are defined to be gain coefficients which were obtained during the three bump tests previously described. Finally, the perturbed dry stock weight at location d is then given by:

$$Dw(d)=U(d)*\{1+[\alpha_T DC_{Td}*w+\alpha_F DC_{Fd}*f+d_s DC_{Sd}*S]\}*Ref(c)$$

The last equation thus describes the effect on dry stock weight due to a specified change in process parameters. Conversely, using the inverse of the DCC matrix one can also deduce how to change the process parameters to produce a desired change in dry weight (s), freeness (f) and total water flow (w) for product optimizations.

It should be understood that in the case in which an array 24 of sensor cells as shown in FIG. 3 cannot be placed along the machine or cross direction of the sheetmaking machine due to obstructions within the system, then individual sensor cells are positioned along the cross or machine direction of the system. Each cell can then individually sense changes in conductivity at the point at which they are positioned which can then be used to determined basis weight. As shown in FIGS. 3 and 4*b* a single cell comprises at least one grounded electrode (either 24A(n) or 24B(n) or both) and a center electrode 24D(n).

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A control system for a sheetmaking machine having a wet end including a headbox for discharging wetstock onto a mesh conveyer, and forming elements residing beneath said conveyor at an impingement region of said wetstock onto said conveyer, each of said headbox and forming elements having associated adjustable operating variables controllable by one of fast response actuators, slow response actuators, and both of said fast response and slow response actuators for affecting dry end basis weight, said control system comprising:

a first control loop including a means for obtaining basis weight (BW) measurements within said dry end and a means for converting said dry end basis weight into first control signals, and providing said first control signals to said headbox and forming elements to perform on-line adjustments of said operating variables, said first control loop having an associated first response time;

a second control loop including:

1) a means for obtaining wet-end basis weight (BW) measurements based on measurements of physical properties of said wetstock on said mesh conveyor within said wet end, wherein said wet end BW measurements including at least one of independent cross direction basis weight measurements and machine direction basis weight measurements, 2) a means for predicting said dry end basis weight from said wet end basis weight measurements, and 3) a means for converting said predicted dry end basis weight into second control signals and providing said second control signals to said headbox and forming elements to perform on-line adjustments of said operating variables, said second control loop having an associated second response time;

wherein said second response time is faster than said first response time and wherein said slow response actuators responding to said first control signals so as to perform coarse operating variable adjustments and said fast response actuators responding to said second control signals to perform fine operating variable adjustments.

2. The control system as described in claim 1 wherein one of said associated headbox operating variables includes headbox pressure which is adjustable by controlling with said first and second control signals at least one of a pressure valve and speed of a pump providing said wetstock to said headbox.

3. The control system as described in claim 1 wherein one of said associated headbox operating variables includes headbox flow, and wherein said headbox includes a plurality of orifices with adjustable openings for discharging said wetstock onto said mesh conveyer, wherein said headbox flow is adjustable by controlling with said first and second control signals said orifice openings.

4. The control system as described in claim 1 wherein one of said associated headbox operating variables includes headbox air pad which is adjustable by controlling with said first and second control signals a pressure valve.

5. The control system as described in claim 1 wherein one of said associated headbox operating variables includes headbox total dilution which is adjustable by controlling with said first and second control signals a whitewater intake valve.

6. The control system as described in claim 1 wherein one of said associated headbox operating variables includes jet-to-wire ratio which is adjustable by controlling with said first and second control signals said mesh conveyer speed by controlling conveyer driver rollers.

7. The control system as described in claim 1 wherein one of said associated forming element operating variables includes forming board machine direction position relative to said region of impingement which is adjustable by controlling with said first and second control signals rapid hydraulic pistons.

8. The control system as described in claim 1 wherein one of said associated forming element operating variables includes forming board angular position relative to said wire which is adjustable by controlling with said first and second control signals rapid hydraulic pistons.

9. The control system as described in claim 1 wherein said basis weight measurements are based on machine direction measurements.

10. The control system as described in claim 1 wherein said basis weight measurements are based on cross direction measurements.

11. The control system as described in claim 1 wherein said dry end BW measurements are taken using a measurement instrument having a scanning type sensor and said wet end BW measurements are obtained using a measurement instrument which instantaneously senses multiple points in the sheetmaking machine.

12. The control system as described in claim 1 wherein said dry end and said wet end basis weight measurements are obtained using a measurement instrument which instantaneously senses multiple points in the sheetmaking machine.

13. The control system as described in claim 11 or 12 wherein said instantaneous sensor includes an electrode configuration for electrically detecting property changes of materials being processed in said sheetmaking machine to obtain said basis weight measurements.

14. The control system as described in claim 1 wherein said first and second control signals include at least one machine direction control signal for controlling MD operating variables and cross direction control signals for controlling CD operating variables.

15. The control system as described in claim 1 wherein said means for obtaining basis weight measurements in said wet end comprises a sensing means including at least one sensor array of sensor cells, each cell corresponding to one of said multiple points, said plurality of cells being arranged essentially in a line perpendicular to said machine direction of said sheetmaking machine, said first sensor array providing said independent cross direction basis weight measurements.

16. The control system as described in claim 1 wherein said sensing means comprises a plurality of individual sensor cells arranged along said machine direction of said sheetmaking machine for providing said independent machine direction basis weight measurements.

* * * * *